US006112607A

United States Patent [19]

Pauls

[11] Patent Number: 6,112,607

[45] Date of Patent: Sep. 5, 2000

[54] SLANT HOLE PUMPING UNIT

[75] Inventor: Dennis A. Pauls, Wichita, Kans.

[73] Assignee: Westherford Artikicial Lift Systems, Inc., Houston, Tex.

[21] Appl. No.: 09/136,993

[22] Filed: Aug. 20, 1998

Related U.S. Application Data

[60] Provisional application No. 60/056,592, Aug. 20, 1997.

[51] Int. Cl.[7] ..... F16H 21/22

[52] U.S. Cl. ..... 74/44; 254/335

[58] Field of Search ..... 74/41, 44; 354/335

[56] References Cited

U.S. PATENT DOCUMENTS 4,051,736 10/1977 Jones ..... 74/41
4,121,471 10/1978 Chancellor ..... 74/41
4,483,208 11/1984 Parker, Jr. ..... 74/41
4,505,162 3/1985 Hoh et al. ..... 74/41
4,631,970 12/1986 Pauls ..... 74/44
4,686,862 8/1987 Mair et al. ..... 74/44

*Primary Examiner*—David M. Fenstermacher
*Attorney, Agent, or Firm*—Shughart, Thomson & Kilroy P.C.

[57] ABSTRACT

A slant hole pumping unit includes a base mounting a support structure. A drive system is mounted on the support structure and is connected to a bridle strap assembly for reciprocating same. A constraint link assembly includes a lower end pivotally connected to the base and an upper end engaging the bridle strap assembly for constraining the movement thereof to an arc defined by the pivotal movement of the bridle strap assembly.

4 Claims, 9 Drawing Sheets

SLANT HOLE PUMPING UNIT

This application claims the benefit of U.S. Provisional Application Ser. No. 60/056,592, filed Aug. 20, 1997.

BACKGROUND OF THE INVENTION

1. Field of the Invention

The present invention relates generally to well head pumping units and in particular to a pumping unit with a constrained bridle strap.

2. Description of the Prior Art

Well head pumping units are placed over wells for operating down-hole pumps whereby oil, water, etc. are extracted and brought to the earth's surface. The Pauls U.S. Pat. No. 4,631,970 discloses a pumping unit with a bridle strap connecting the drive system thereof with a rod string. The flexible bridle strap transfers the reciprocating motion of the pumping unit drive system to a vertically reciprocating motion of the rod string. However, the equalizer beam which connects the drive system to the bridle strap assembly in this pumping unit is unconstrained. Thus, the equalizer beam can damage other components of the pumping unit if tension is released, e.g., if the rod string breaks. The pumping unit shown in the aforementioned Pauls '970 patent is designed to equally divide the rotation of the drive system between the upstroke and downstroke of the rod string, i.e. 180°/180°. However, in many applications different upstroke/downstroke ratios are preferred. For example, relatively high viscosity oil and/or slant hole applications often necessitate a slower downstroke in order to maintain tension on the bridle strap assembly.

The present invention addresses the shortcomings of the prior art. Heretofore there has not been available a slant hole pumping unit with the advantages and features of the present invention.

SUMMARY OF THE INVENTION

In the practice of the present invention, a slant hole pumping unit is provided which includes a base, a support structure mounted on the base and a drive system mounted on the support structure. Crank arms are driven by the drive system and are connected to a bridle strap assembly through a pitman arm assembly. The bridle strap assembly is also connected to a rod string. A post assembly includes a lower end mounted on the base and the support structure and an upper end mounting a post strap guide. A constraint link includes a lower end pivotally connected to the base and an upper end engaging the bridle strap assembly for constraining the movement thereof through a pivotal arc defined by the bridle strap assembly.

OBJECTS AND ADVANTAGES OF THE INVENTION

The principal objects and advantages of the present invention include: providing a pumping unit for well head applications; providing such a pumping unit which is adapted for slant hole pumping applications; providing such a pumping unit which constrains movement of a bridle strap; providing such a pumping unit which permits adjustment of the upstroke and downstroke portions of a drive system cycle; providing such a pumping unit which can increase reliability in the field; and providing such a pumping unit which is economical to manufacture, efficient in operation and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
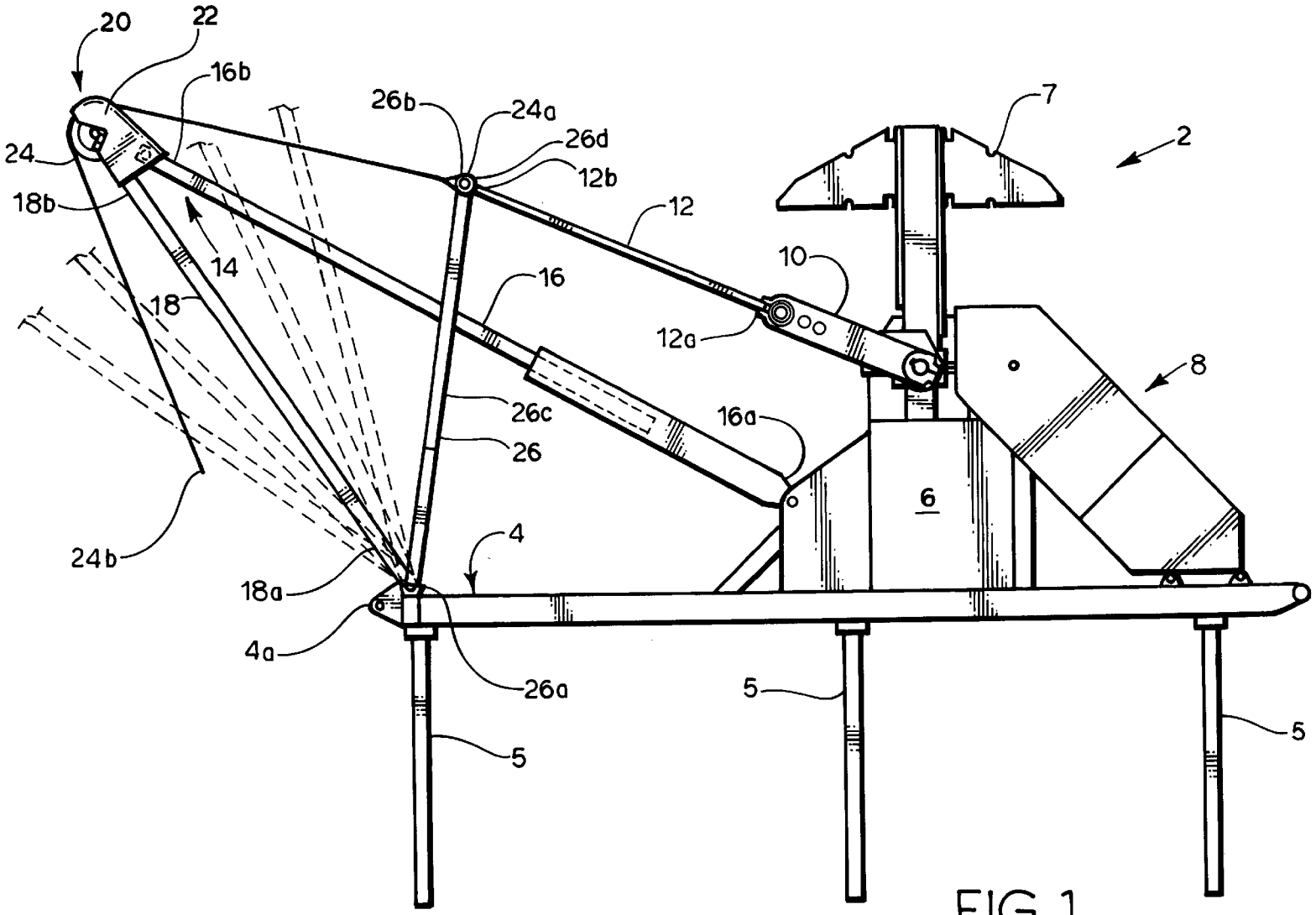
FIG. 1 is a side elevational view of a pumping unit embodying the present invention.
Figure 2:
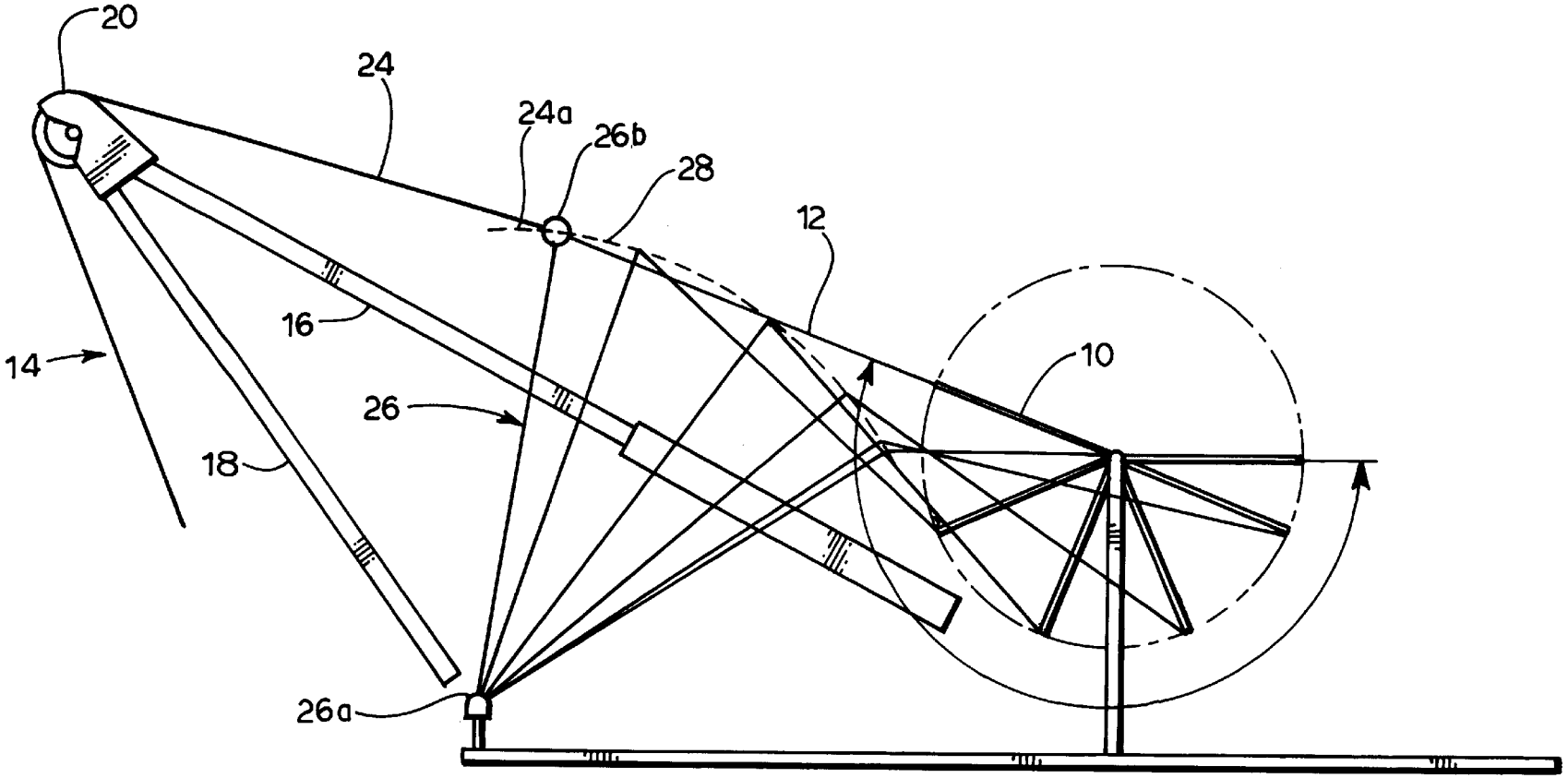
FIG. 2 is a side elevational view of the pumping unit showing upstroke positions thereof.
Figure 3:
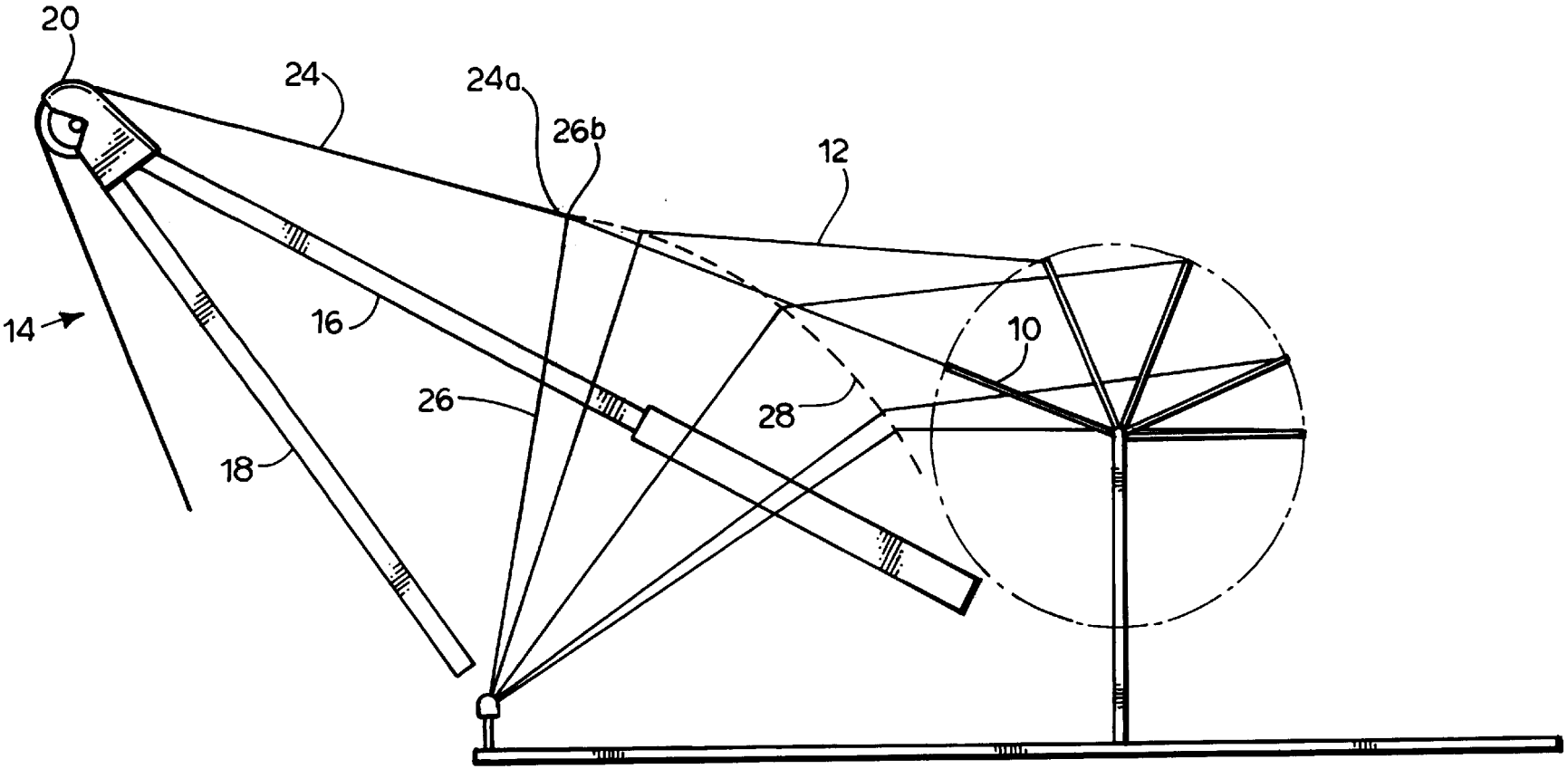
FIG. 3 is a side elevational view of the pumping unit showing downstroke positions thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a pumping unit embodying the present invention. The pumping unit 2 uses a bridle strap assembly 24 and other components which are similar to those shown in U.S. Pat. No. 4,631,970, which is incorporated herein by reference.

II. Pumping Unit 2

The pumping unit 2 includes a base 4 which mounts a support structure 6 extending upwardly therefrom. The support structure mounts a drive system 8 with counterweights 7. The drive system 8 rotates a pair of crank arms 10. A pair of pitman arms 12 have proximate ends 12*a* connected to the crank arms 10 and distal ends 12*b*. The base can be supported on any suitable foundation, such as the piers 5. The base can also comprise or be mounted on a vehicle, such as a trailer or truck bed.

A post assembly 14 includes a length-adjustable rear post leg 16 with a proximate end 16*a* pivotally connected to the support structure 6 and a distal end 16*b*. The post assembly 14 also includes a front post leg 18 with a proximate end 18*a* pivotally connected to the base 4 in proximity to a base front 4*a* and a distal end 18*b*. The post leg distal ends 16*b*, 18*b* mount a strap guide assembly 20 which comprises a roller 22 rotatable on a horizontal, transverse rotational axis. A bridle strap assembly 24 includes proximate and distal ends 24*a,b* and is placed over the roller 22.

Figure 6:
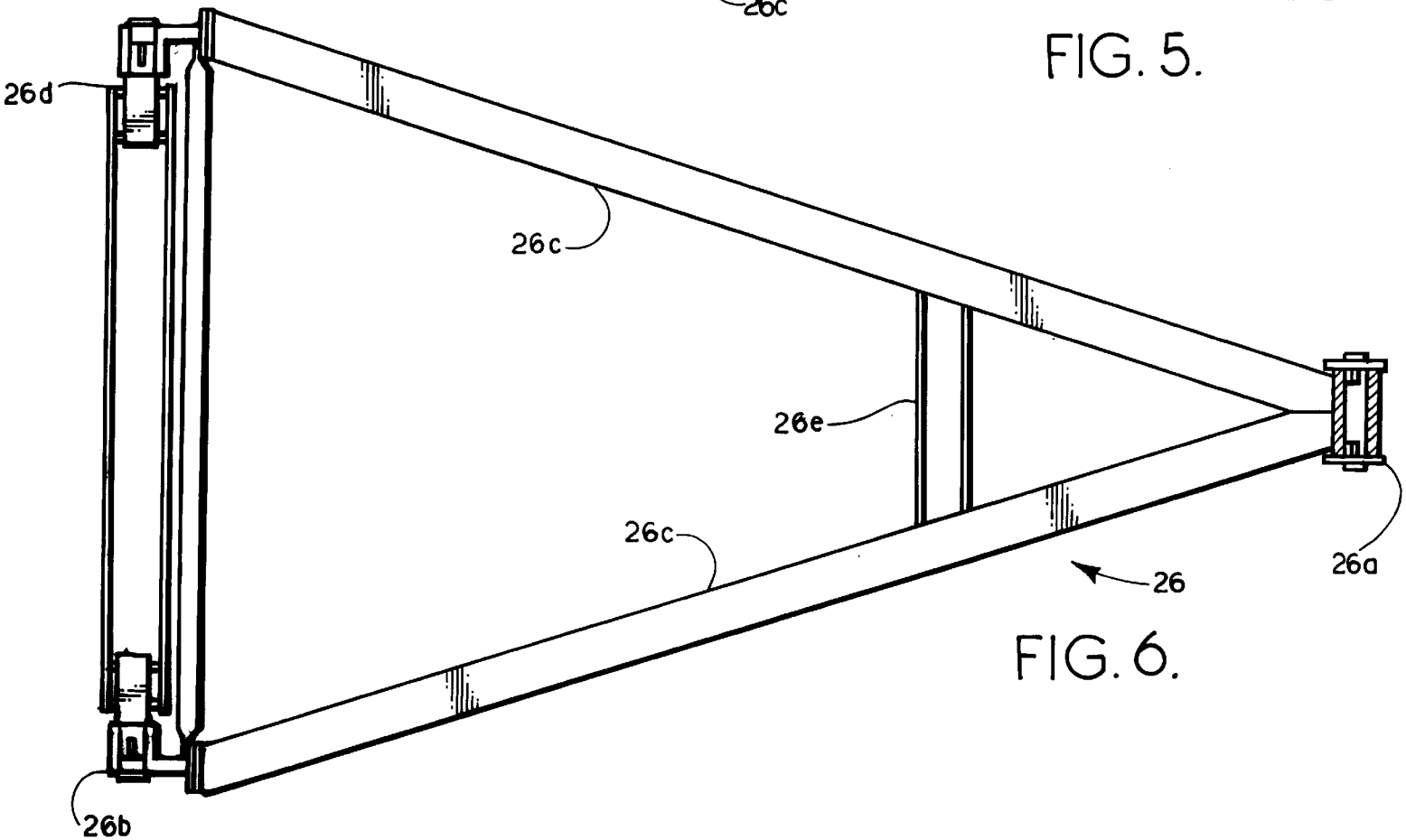
FIG. 6 is a front elevational view of the constraint link assembly.

A constraint link assembly 26 includes a lower end 26*a* pivotally mounted on the base 4 adjacent to its front end 4*a* and an upper end 26*b* pivotally connected to the pitman arm distal ends 12*b* and to the bridle strap assembly proximate end 24*a*. The constraint link assembly 26 has a generally triangular configuration as shown in FIG. 6 with a pair of side members 26*c*, a equalizer beam 26*d* at its upper end 26*b* and a brace 26*e* extending between and connected to the side members 26*c*.

III. Operation

Figure 4:
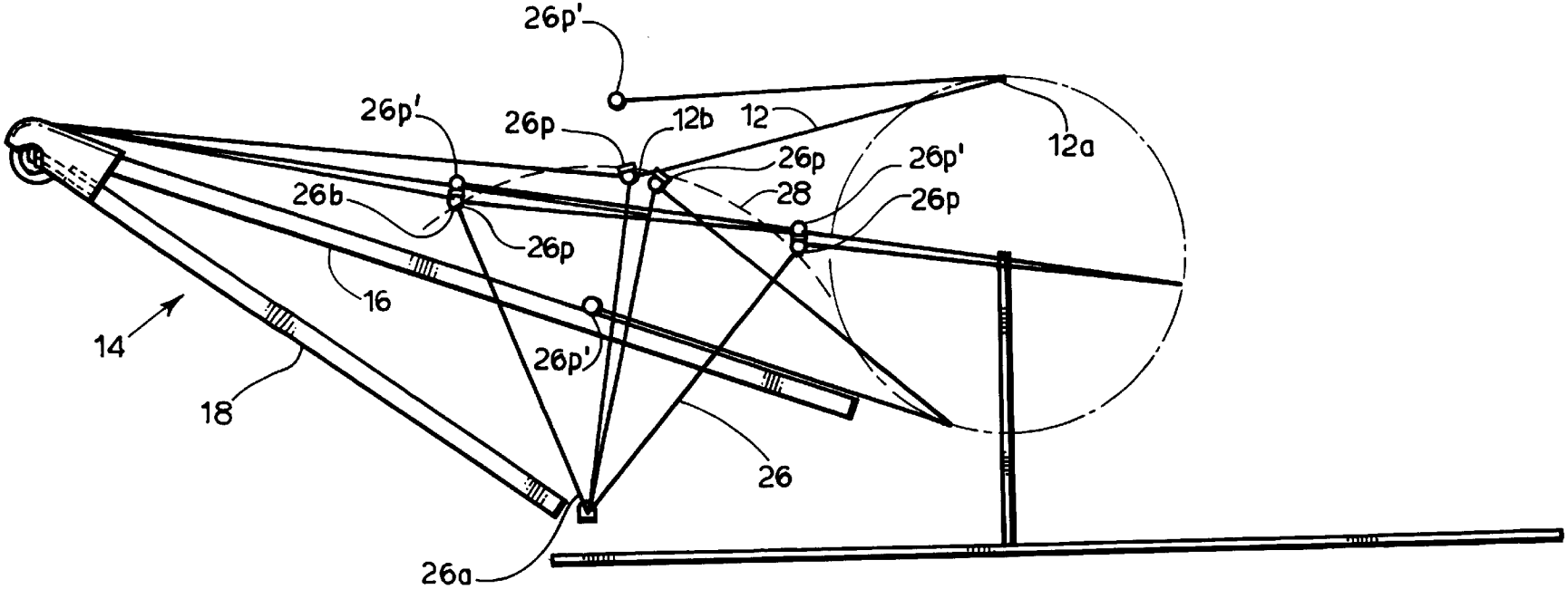
FIG. 4 is a side elevational view showing a comparison of constrained and unconstrained equalizer beam paths of movement and positions.
Figure 5:
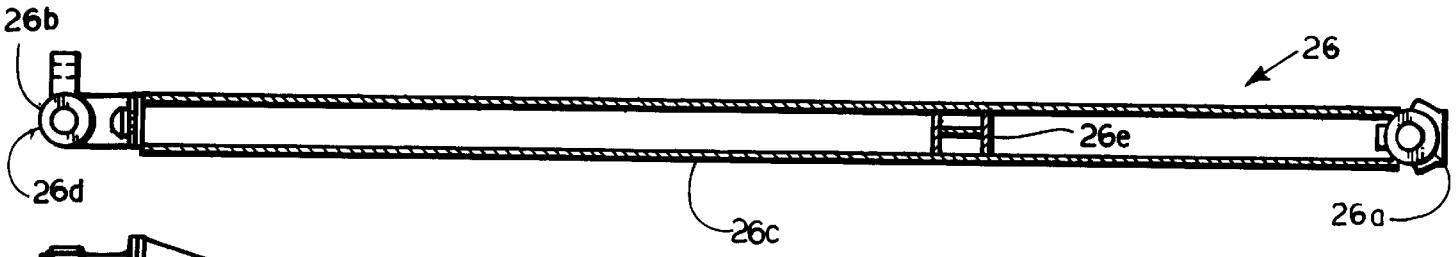
FIG. 5 is a side elevational view of a constraint link assembly of the pumping unit.

In operation, the pumping unit 2 functions in a manner similar to the pumping unit disclosed in U.S. Pat. No. 4,631,970, except that the constraint link assembly 26 constrains the equalizer beam 26*d* to a predetermined arc of movement 28 defined by the pivoting motion of the constraint link assembly 26. FIG. 4 shows an equalizer beam 26*d* path of movement describing an arc 28 when constrained by the constraint link assembly 26 with various equalizer beam 26*d* positions designated 26*p*. Positions of the equalizer beam 26*d* if it were not so constrained are designated 26*p'*.

By adjusting the length and end locations of the constraint link assembly 26 with respect to the other components of the pumping unit 2, a variety of stroke profiles can be accommodated for particular applications. In particular, the division between upstroke and downstroke can be adjusted to ratios of, such as 208°/152°. For example, lower upstroke speeds may be desirable to reduce power requirements and reduce the acceleration forces on the rod string. The downstroke can have a faster speed, which increases the leverage of the counterweights 7 and reduces the counterbalance weight required on the crank arm to achieve the necessary counterbalance effect on the rod string.

Faster upstroke and slower downstroke can be accomplished by reversing the rotational direction of the crank arms 10. Such operating characteristics may be desirable to compensate for relatively slow rod string fall (downstroke) speed, which can result from relatively high viscosity liquids (e.g., oil) being pumped or a slant hole well configuration.

Figure 7:
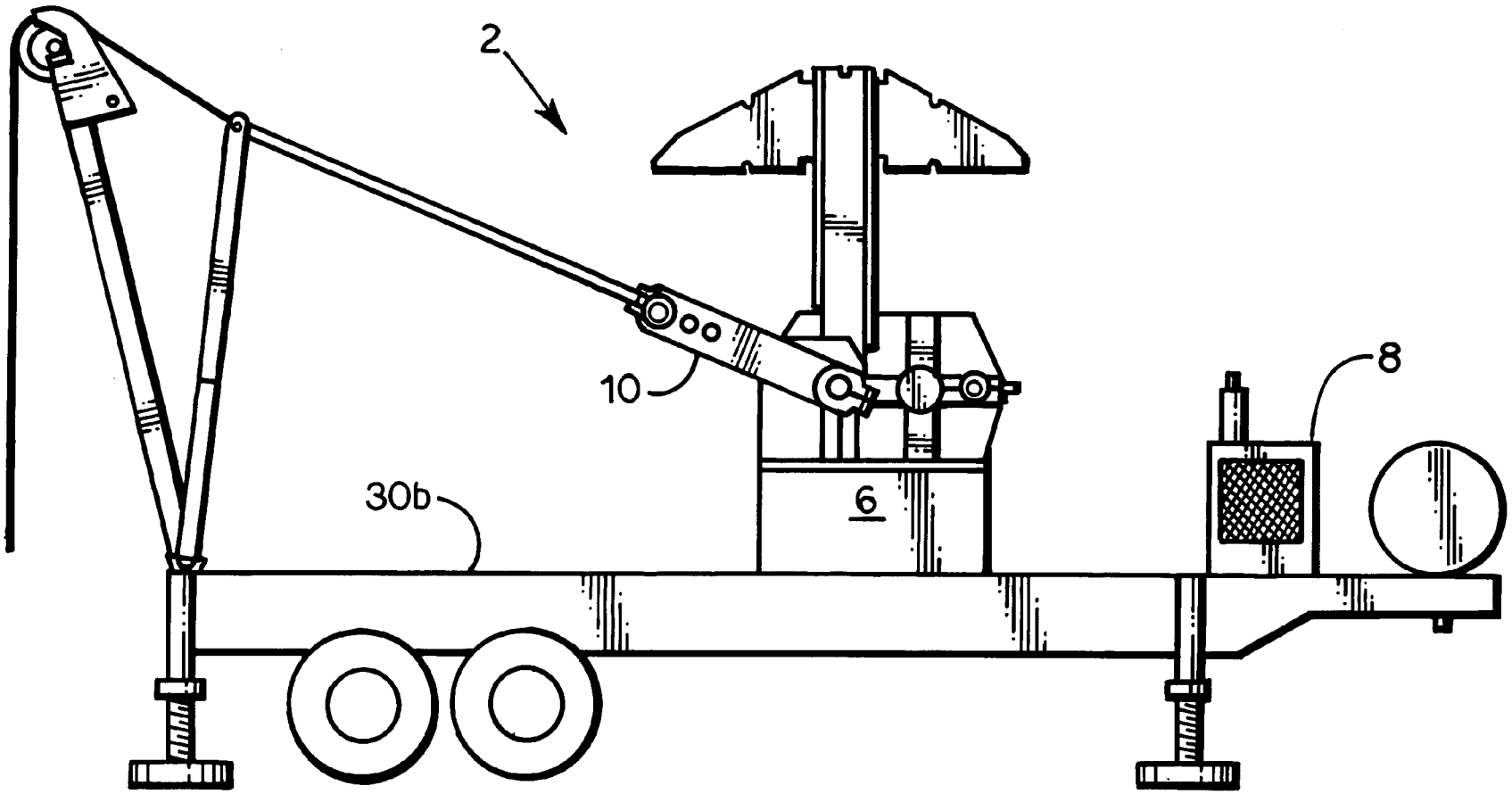
FIG. 7 is a side elevational view of the pumping unit shown mounted on a trailer in an operating position thereof.
Figure 8:
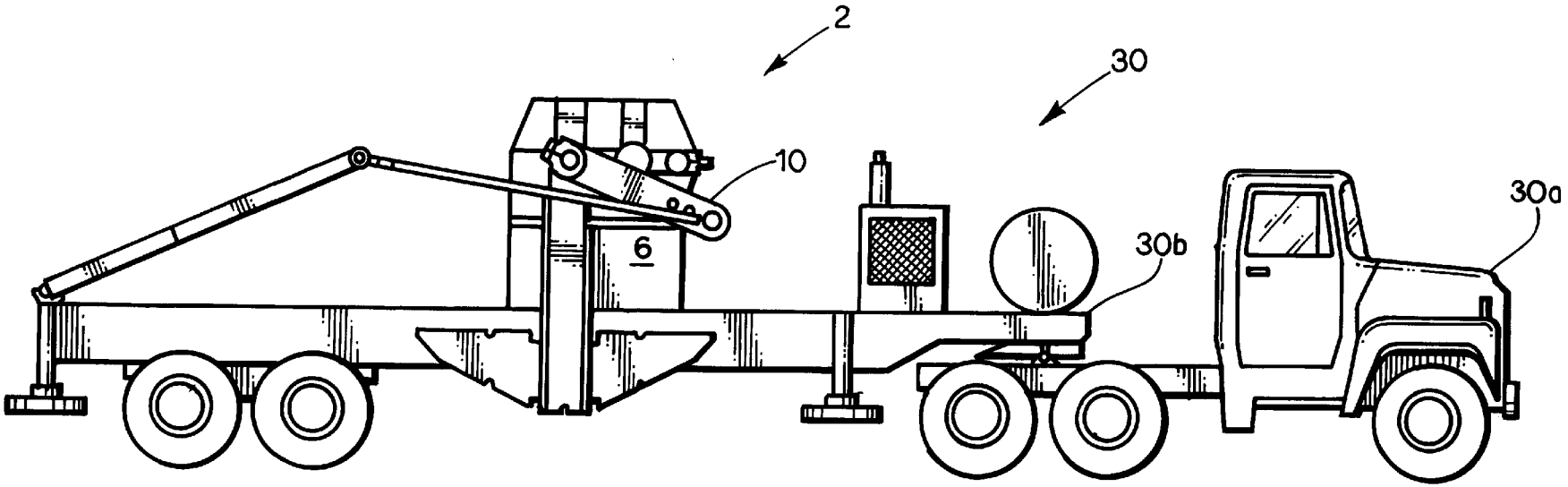
FIG. 8 is a side elevational view of the pumping unit shown mounted on a tractor trailer unit in a transport position thereof.

The pumping unit 2 can be mounted on a trailer 30*b* of a tractor-trailer rig 30 for towing by a tractor unit 30*a*. (FIGS. 7 & 8).

IV. First Modified Embodiment Pumping Unit 102

Figure 9:
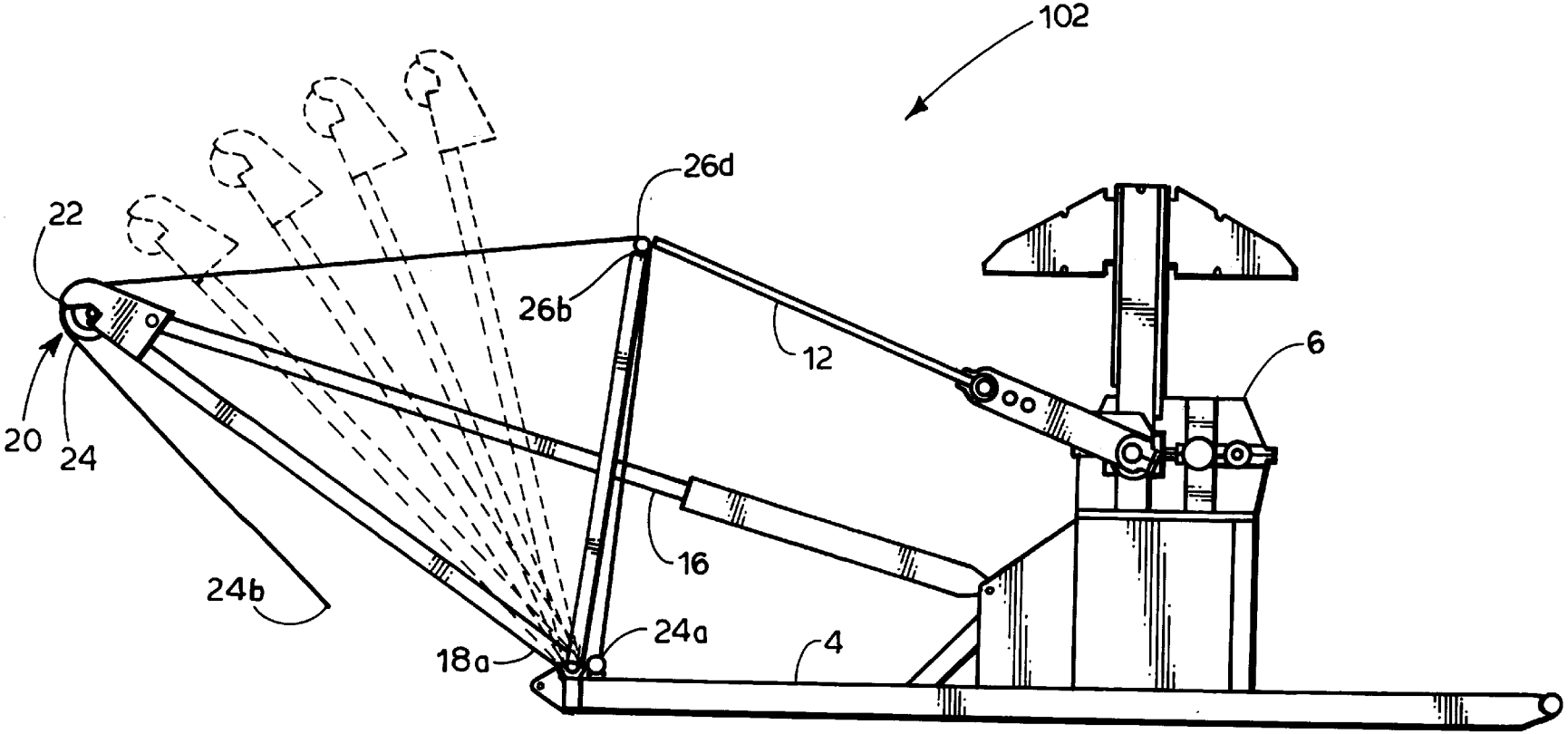
FIG. 9 is a side elevational view of a pumping unit comprising a first modified embodiment of the present invention.

A first modified embodiment pumping unit 102 is shown in FIG. 9 and includes the bridle strap assembly proximate end 24*a* being connected to the base 4 with the equalizer beam 26*d* functioning as a constraint link assembly guide roller. Greater stroke length, i.e. up to twice the crank arm swing diameter, can be achieved with this configuration.

V. Second Modified Embodiment Pumping Unit 202

Figure 10:
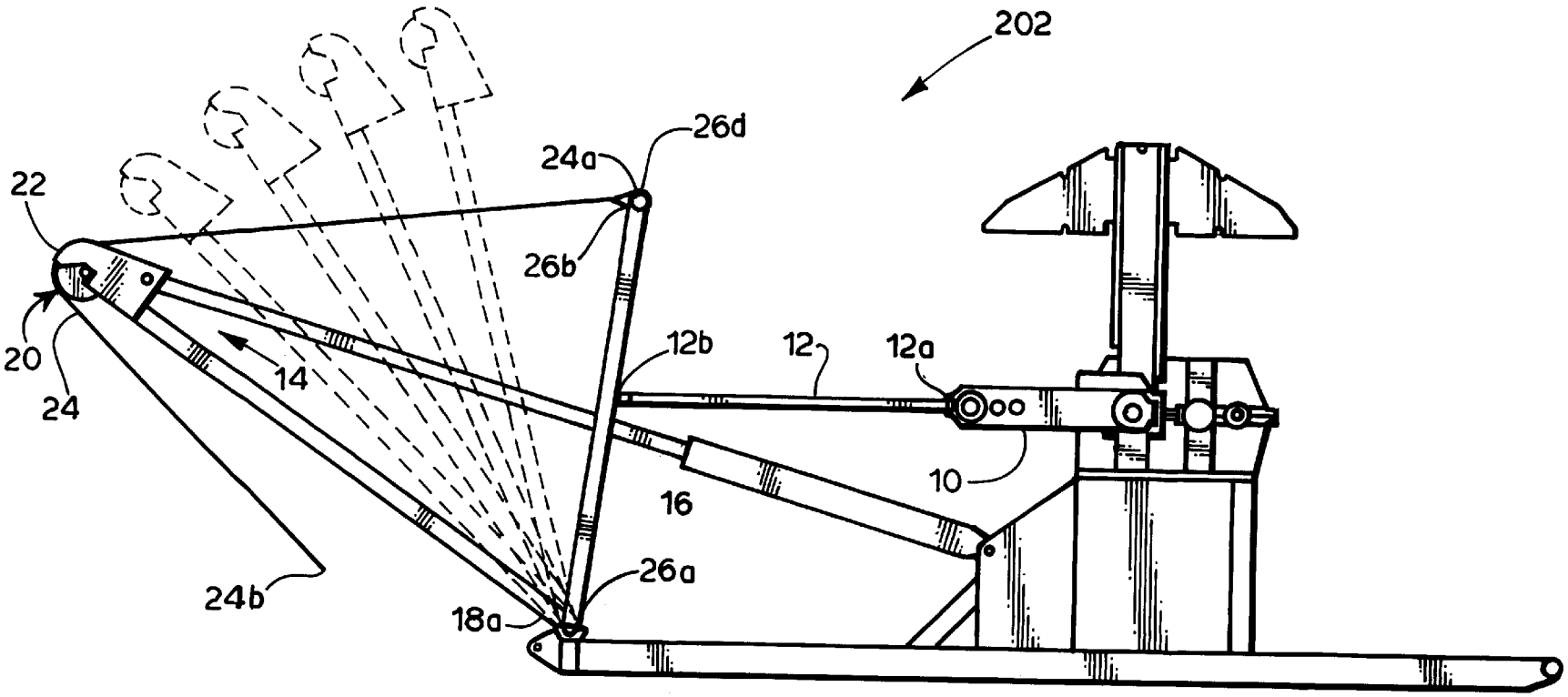
FIG. 10 is a side elevational view of a pumping unit comprising a second modified embodiment of the present invention.

FIG. 10 shows a pumping unit 202 comprising a second modified embodiment of the present invention wherein the pitman arm distal ends 12*b* are connected to the constraint link assembly 26 intermediate its lower and upper ends 26*a,b*. Stroke amplification is thus achieved based upon a ratio defined by the placement of the bridle strap assembly proximate end 24*a* with respect to the constraint link assembly lower and upper ends 26*a,b*. In this configuration the second modified embodiment pumping unit 202 functions as a four bar linkage system.

It is to be understood that while certain forms of the present invention have been illustrated and described herein, it is not to be limited to the specific forms or arrangement of parts described and shown.

What is claimed and desired to be secured by Letters Patent is as follows:

1. A well head pumping unit, which comprises:

(a) a base;

(b) a support structure mounted on the base and extending upwardly therefrom;

(c) a drive system mounted on the support structure;

(d) a crank arm connected to the drive system and rotatable thereby;

(e) a pitman arm assembly pivotally connected to the crank arm;

(f) a post assembly with a lower end connected to the base and an upper end;

(g) a strap guide mounted on said post assembly upper end;

(h) a strap assembly with a distal end adapted for connection to a rod string and a proximate end;

(i) a constraint link assembly with a lower end pivotally connected to said base and an upper end, said constraint link assembly being connected to said pitman arm assembly distal end in spaced relation from said constraint link assembly lower end;

(j) said constraint link assembly engaging said strap assembly in spaced relation from said constraint link assembly lower end;

(k) said constraint link assembly having a constraint link strap guide engaging said strap assembly; and (l) said strap assembly proximate end being connected to said base.

2. The pumping unit according to claim 1, which includes:

(a) said pitman arm assembly distal end and said strap assembly proximate end being connected to said constraint link assembly upper end.

3. The pumping unit according to claim 1, which includes:

(a) said post assembly further comprising a front post leg with proximate and distal ends, said front post leg proximate end connected to said base, and a rear leg with a proximate end connected to said support structure and a distal end connected to said front post leg distal end.

4. The pumping unit according to claim 1, which includes:

(a) said strap assembly proximate end being connected to said constraint link assembly upper end; and (b) said pitman arm assembly distal end being connected to said constraint link assembly intermediate said constraint link assembly lower and upper ends.

* * * * *